US005203949A

United States Patent [19]

Pattarozzi

[11] Patent Number: 5,203,949

[45] Date of Patent: Apr. 20, 1993

[54] DEVICE FOR TAPING CONTAINERS WITH STRIPES OF ADHESIVE TAPE

[75] Inventor: Domenico Pattarozzi, S. Lazzaro Di Savena, Italy

[73] Assignee: PRB Packaging Systems S.R.L., Bologna, Italy

[21] Appl. No.: 643,733

[22] Filed: Jan. 22, 1991

[30] Foreign Application Priority Data

Jan. 26, 1990 [IT] Italy ..... 3317A/90

[51] Int. Cl.[5] ..... B31F 5/00

[52] U.S. Cl. ..... 156/468; 156/522; 156/523; 156/486

[58] Field of Search ..... 156/468, 523, 522, 526, 156/486

[56] References Cited

U.S. PATENT DOCUMENTS

| | | | |
|---|---|---|---|
| 2,052,903 | 9/1936 | Stagmeier | 156/468 |
| 2,643,016 | 6/1953 | Steckling | 156/468 |
| 2,906,428 | 9/1959 | Fritzinger | 156/468 |
| 3,880,701 | 4/1975 | Moree | 156/526 |
| 3,984,278 | 10/1976 | Styner et al. | 156/523 |
| 4,045,273 | 8/1977 | Loveland et al. | 156/522 |
| 4,213,285 | 7/1980 | Mancini . | |
| 4,238,270 | 12/1980 | Warshaw et al. | 156/468 |
| 4,537,649 | 8/1985 | Ulrich et al. | 156/468 |
| 4,707,202 | 11/1987 | Sweeny | 156/523 |
| 4,889,581 | 12/1989 | Ulrich et al. | 156/468 |
| 4,923,559 | 5/1990 | Kennedy et al. | 156/523 |
| 4,964,942 | 10/1990 | Tsuda | 156/468 |
| 5,053,096 | 10/1991 | Long et al. | 156/506 |

FOREIGN PATENT DOCUMENTS

| | | |
|---|---|---|
| 36398 | 9/1981 | European Pat. Off. . |
| 298294 | 1/1989 | European Pat. Off. . |
| 1810954 | 7/1970 | Fed. Rep. of Germany . |
| 2532410 | 2/1977 | Fed. Rep. of Germany . |
| 3136950 | 10/1982 | Fed. Rep. of Germany . |
| 2187615 | 1/1974 | France . |

*Primary Examiner*—David A. Simmons
*Assistant Examiner*—Merrick Dixon
*Attorney, Agent, or Firm*—Darby & Darby

[57] ABSTRACT

A device includes a pair of taping units disposed symmetrical to a conveying line, along which containers advance spaced out from one another by a spacing suited to allow insertion of the taping units therein at a taping station. Each taping unit has an operating head, movable in a direction transversal to the conveying line, and a pair of rocker means articulated to the operating head, suited to intercept a strip of adhesive tape, which extends from a longitudinal wall of the container located downstream of the taping station, and to diverge elastically in phase of insertion into the spacing, while cutting means, associated with the operating head are suited to cut the strip held by the rocker means and means for driving the cutting means are actuated when the operating head is inserted in the spacing.

3 Claims, 3 Drawing Sheets

S
2
N
1
25
18
16
7
3
5
13
2a
2b
25a
L

DEVICE FOR TAPING CONTAINERS WITH STRIPES OF ADHESIVE TAPE

BACKGROUND OF THE INVENTION

The present invention relates to the technical field of the machines for packaging products into box-type containers.

These machines provide for forming the box-type container, e.g. starting from a suitable cardboard blank, and for filling it with a plurality of packaged products.

Then the walls of the container are locked by means of stripes of adhesive tape.

Therefore, the need arises to apply the adhesive tape to the containers automatically, in a fast and efficient way, so to avoid slowing down the production line.

DESCRIPTION OF THE PRIOR ART

At present in the afore-said machines the container to be sealed is made to pass by a taping device which provides for applying a strip of adhesive tape on the heads of the container. The ends of said strip of adhesive tape are opportunely applied on the longitudinal walls of the container, wrapping the edges formed by said walls and the heads.

In fact it is well-known that the tear resistance of the taping is dependent on the portion of tape which is able to operate under traction. In particular, the strength of the taped bottom of the container depends on the portion of tape applied on the side walls of the container, i.e. in a direction parallel to the stress exerted by the products on the bottom itself.

However, the taping devices presently known are not suited to ensure the application of a side portion of tape sufficiently long; or they leave flaps of tape not adherent to the container and therefore useless for the desired purpose.

Other known devices require a subsequent finishing on special pressing rollers, with an obvious waste of time, increase in production costs and further complexity of the gears designed for this purpose.

SUMMARY OF THE INVENTION

One of the objects of this invention is to provide a device able to carry out, in a fast and efficient way, the taping of containers with strip of adhesive tape, thus ensuring the strength of the same taping.

Another object of the present invention is the provision of a device for taping containers with strip of adhesive tape, which turns out to be of simple construction, not very cumbersome, functional and reliable, as well as of versatile use.

The above-mentioned objects are accomplished by means of a device for taping containers with strip of adhesive tape.

The device comprises a pair of taping units disposed symmetrical to the sides of a conveying line, along which containers are made to advance spaced out from one another by a spacing suited to allow the insertion of the taping units therein, at a taping station.

Each taping unit comprises an operating head, movable alternatively in a direction transversal to the conveying line, and a pair of rocker means articulated with the operating head which are suited to intercept a strip of adhesive tape, which extends from a longitudinal wall of the container placed downstream of the taping station.

The rocker means are also suited to diverge elastically when they are inserted into the spacing, so to act by pressure on the front and rear heads of the containers disposed respectively downstream and upstream of the taping station.

Cutting means, associated with said operating head, are suited to cut the strip of adhesive tape held by the rocker means, while means for driving the cutting means are actuated in phase relationship with the insertion of the operating head into said spacing.

BRIEF DESCRIPTION OF THE DRAWINGS

The invention will be described further, by way of example, with reference to the accompanying drawings, wherein.

DESCRIPTION OF THE PREFERRED EMBODIMENT

Figure 2:
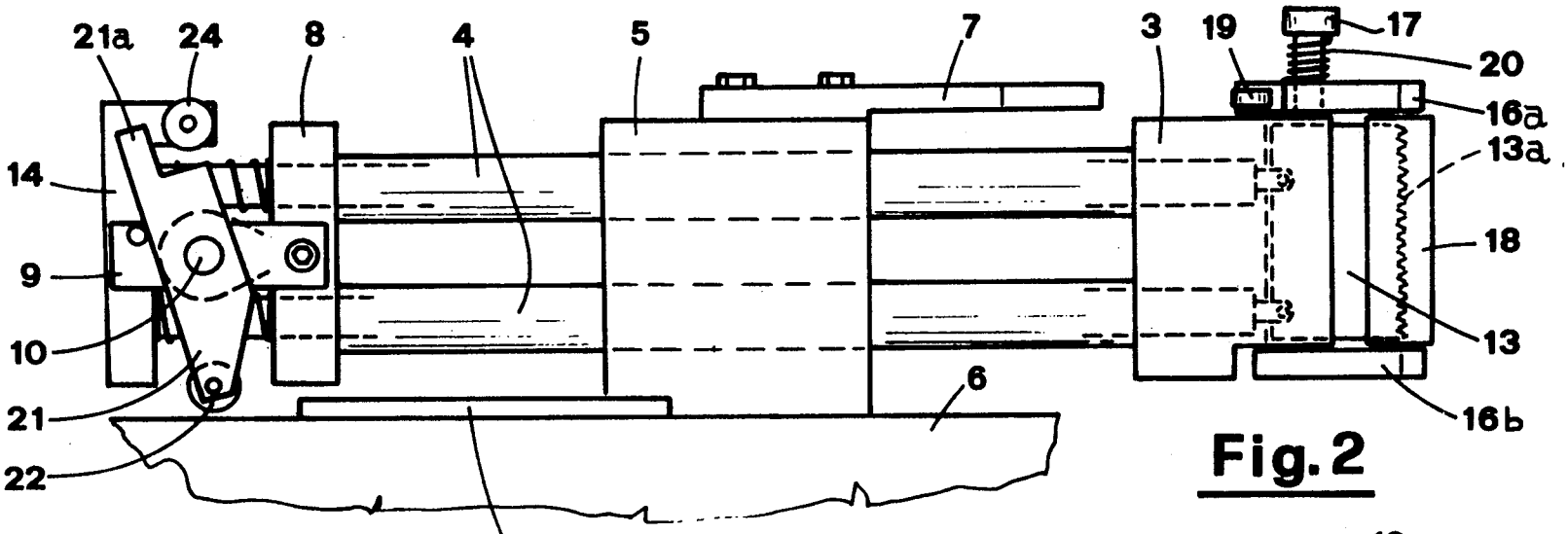
FIG. 2 is a side view of said taping unit.

Referring to the above-mentioned figures, the taping device comprises a pair of taping units, generally designated by the numeral 1, which are disposed symmetrical to the sides of a line L for conveying the containers 2. The containers advance in step along said line, spaced out from one another by a spacing S (FIG. 3), of adjustable width, suited to allow the insertion of the taping units 1 correspondingly with a taping station N.

The taping units 1, of which only one is illustrated in the drawings, respectively provide an operating head which is movable alternatively in a direction transversal to the conveying line L, between a position external to the same line and a position of maximum insertion inside the spacing S.

The operating head 3 is fastened to an end of a pair of rods 4 which are slidably guided through a support body 5 stably integral with the frame 6 of the machine. The support body 5 bears, fastened to its top, a wedge 7 having its point turned towards the operating head 3.

Figure 1:
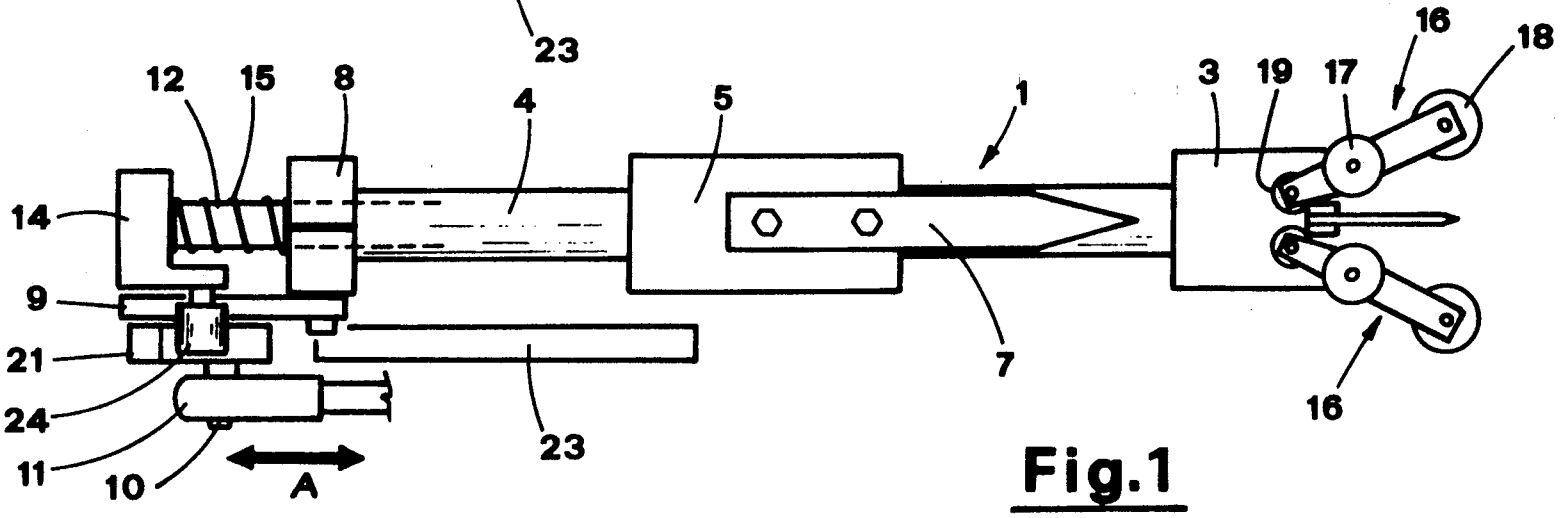
FIG. 1 is a plan view of a taping unit of the device provided by the present invention.

At the opposite end the rods 4 are connected by a rear head 8. To the rear head 8 is fastened, longitudinally to the rods 4, a bracket 9 with which is articulated, on a transverse pin 10, a driving arm 11. The arm is set in reciprocating motion by suitable motive means, as indicated by arrow A in FIG. 1.

The rods 4 have a tubular shape and bear, sliding inside themselves, respective stems 12 protruding, at the opposite ends, from the rods themselves.

At one end the stems 12 bear a cutting means 13 provided with a toothed blade 13*a*. The cutting means 13 is disposed in a vertically middle position correspondingly with the operating head 3.

At the other end the stems 12 are connected by a bar 14. On the portion of the stems 12 protruding at the rear from the rods 4 is mounted a pair of helical springs 15, acting by compression between the rear head 8 and the bar 14. The springs 15 are aimed at keeping the cutting means 13 elastically striking against the operating head 3, in rest position.

With the operating head 3 is articulated a pair of rocker means 16, independent of each other, revolving on a relative central pivot 17 with vertical axis. The rocker means 16 are respectively made up of a pair of rockers 16a, 16b mounted parallel on the upper face and on the lower face of the operating head 3 and connected at one of their ends by a roller 18; the roller 18 has a vertical axis and thus results to be parallel to the surface of the heads 2a and of the side walls 2b of the containers conveyed on the line L.

At the opposite end, the upper rockers 16a bear respective rollers 19, rotating and having vertical axes. The upper rockers 16a are practically disposed on the same horizontal plane as the wedge 7.

The rocker means 16 are impelled by relative spring means 20, fastened to the pivots 17 and suited to keep the same means 16 elastically diverging at their front end, i.e. correspondingly with the rollers 18. The closing of the rocker means 16 is designed to be actuated by the insertion of the wedge 7, as will be hereinafter pointed out.

On the pin 10 of articulation of the arm 11 is also mounted a rocking lever 21 driving the cutting means 13. The lever 21 bears at its lower end a roller 22 which is suited to engage with a longitudinal cam 23 fixed on the frame 6 of the machine; whereas at its upper end it features a tooth 21a which is suited to engage with a roller 24 supported cantilevering, with horizontal axis, by the bar 14.

The rocker means 16 are suited to intercept, through the rollers 18, a strip of adhesive tape 25 to be applied on the cardboard containers 2. In particular, the rocker means intercept the portion of adhesive tape 25 which extends between conventional tape-feeding means, not illustrated in the drawing, and the longitudinal wall 2b of the container 2 located downstream of the taping station N.

The containers 2 advance in step along the conveying line L, stopping when the spacing S is in correspondence with the taping station N. In that very instant the operating head 3 is in a position external to the spacing S, as it may be seen in FIG. 3a. In such a position, the operating head 3 is close to the support body 5 and consequently the wedge 7 results to be inserted between the rocker means 16, so that these latter turn out to be basically parallel to each other.

With the stopping of the conveying line L, the operating head 3 is actuated to move inwards into the spacing S, through the sliding of the outer rods 4 on the support body 5. Said move causes the opening of the rocker means 16 in the diverging position, as it may be seen in FIG. 3b.

As a matter of fact the means 16 separate from the wedge 7, fixed to the body 5, and are impelled to open by the respective springs 20.

Through the rollers 18, the rocker means stretch the adhesive tape 25 and act by pressure on the rear and front heads 2a of the containers 2 located respectively upstream and downstream of the taping station N, so bringing about the adhesion of the tape itself to said heads.

Figure 4:
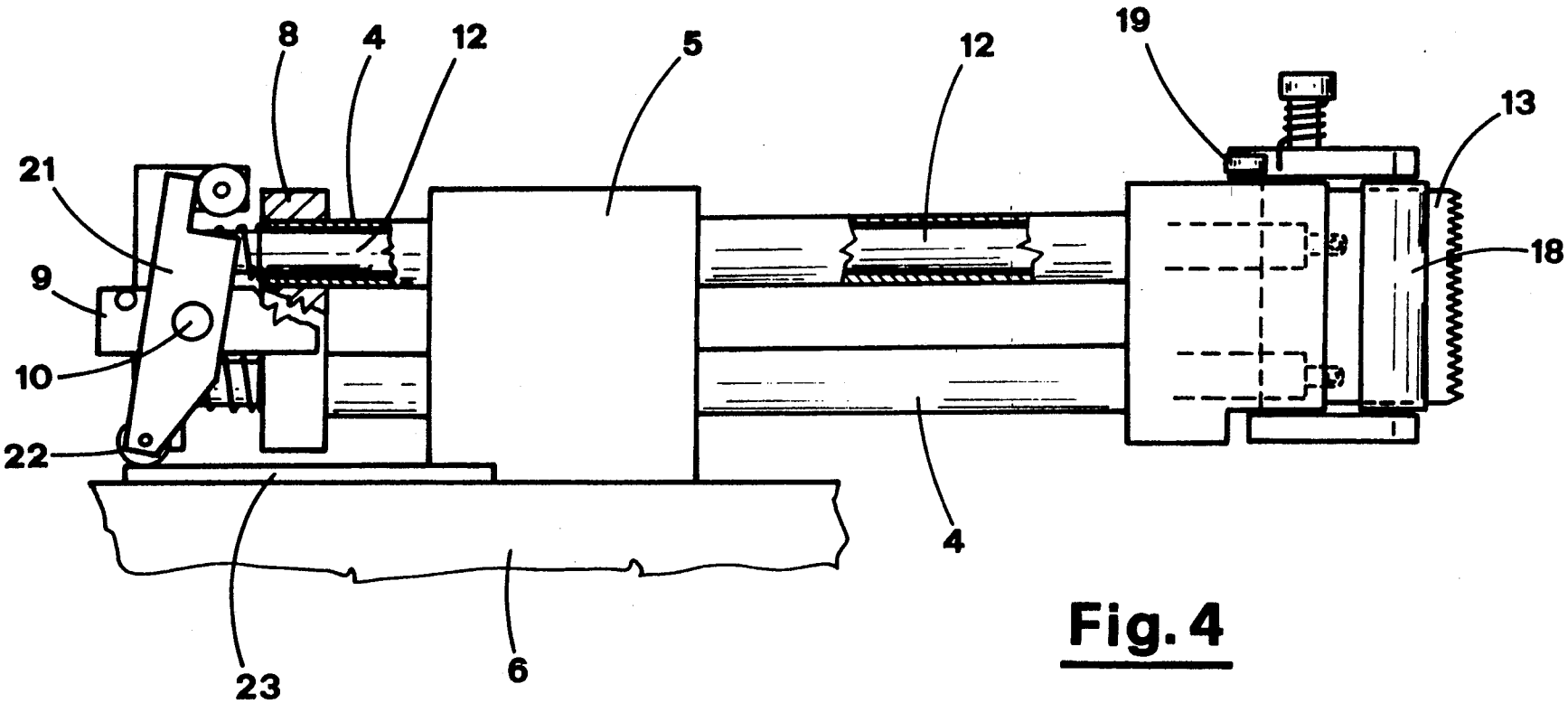
FIG. 4 is a side view, partially sectional, of the taping unit in the phase of cutting said adhesive tape.

Going on with the sliding of the operating head 3, the roller 22 of the lever 21, set in motion by the same head 3, hits the fixed cam 23. This causes the angular rotation of the lever 21 which is forced to act, through the roller 24, on the bar 14 integral with the stems 12. Thus the stems 12 slide inside the rods 4, in contrast with the springs 15, causing the advance, or release, of the cutting means 13 with respect to the operating head 3, as illustrated in FIG. 4.

Figures 3A, 3B, 3C, 3D:
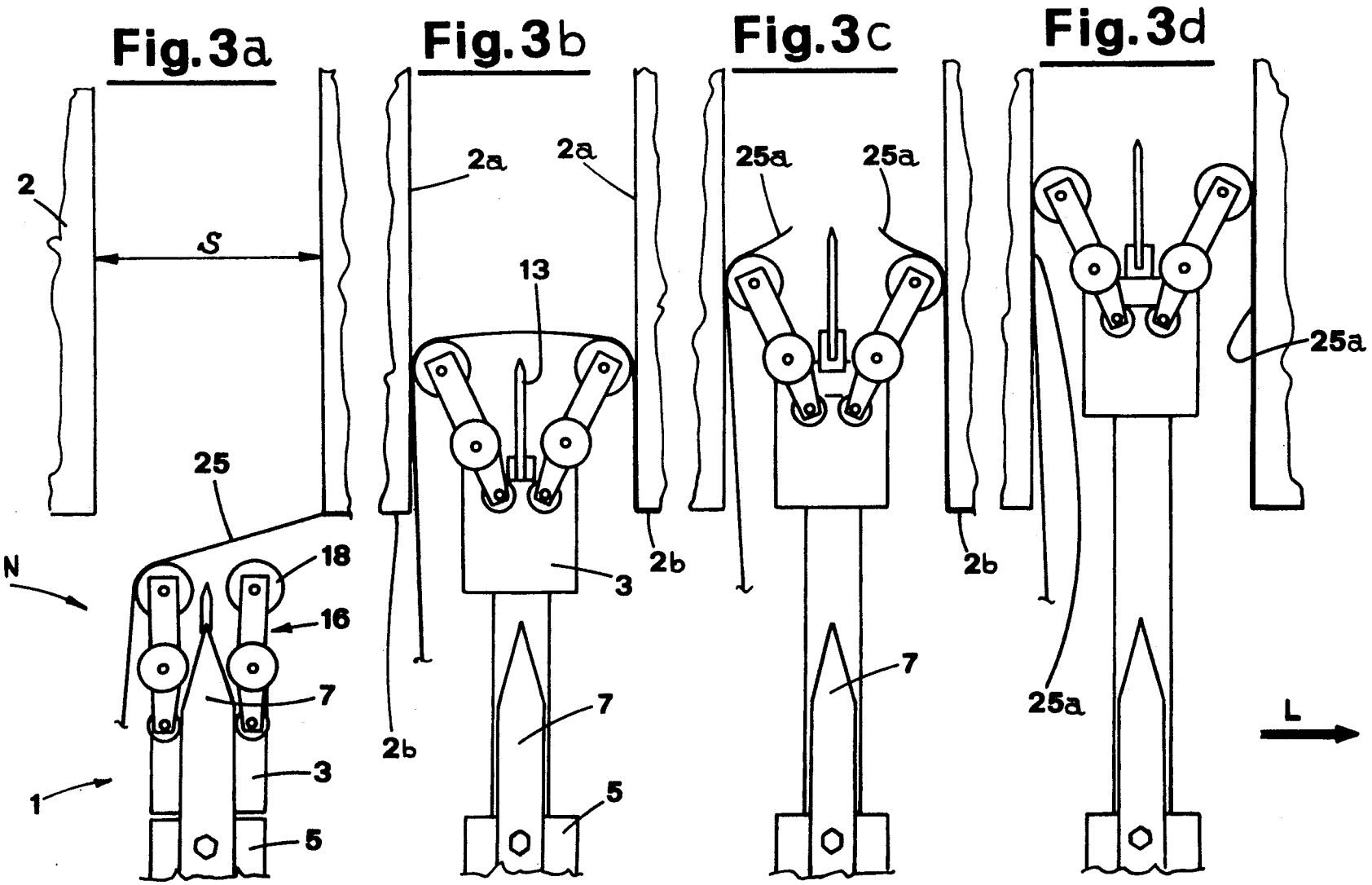
FIGS. 3*a*, 3*b*, 3*c* and 3*d* show, in a plan view, subsequent operating phases of the taping unit.

Thus the adhesive tape 25 is cut by the blade 13a of the cutting means 13 in two portions 25a, as it is visible in FIG. 3c. The cutting features are determined by the dimensions and by the position of the cam 23, which is conveniently adjustable according to the requirements of use.

Then the operating head 3 continues its travel, so to allow the rollers 18 to cause the complete adhesion of the portions 25a of the tape to the heads 2a of the containers 2, as it is visible in FIG. 3d.

Once this phase has been completed, the operating head 3 carries out the return travel. The rocker means 16, held in diverging position by the springs 20, press elastically with the rollers 18 against the heads 2a, to complete the application of the portions 25a of the adhesive tape 25.

At the end of the return travel, the rocker means 16 engage again with the wedge 7, through the rollers 19, going back to the closing position.

Thus it is possible to control the advance of the containers 2 along the conveying line L. During said advance, the adhesive tape 25 is applied on the longitudinal wall 2b of the container which previously occupied the position upstream of the taping station N.

From the foregoing it should be readily apparent that the device provided by the present invention is of very simple construction, and it is able to ensure an optimal application of the adhesive tape on the container heads, with extremely reduced overall dimensions.

Furthermore, the device hereinbelow described operates directly on the conveying line and in phase with it, thus no means are required for supplying the taping station with containers.

This means a more simplified construction, and what is more the insertion of the device along the line does not involve a slowing down of the conveying line and thus of the production speed.

A further advantage of the device provided by the invention is its automatic adjustment to uneven spacings among the containers, without prejudice of the quality of taping.

It should also be appreciated that the device provided by the invention allows the use of any kind of tape, e.g. adhesive paper to be moistened, which is cheaper than the self-adhesive tape, but not applicable in the case that the device operates with the containers in motion, owing to the insufficient initial adhesion of the glueing.

It is understood that the above has been described by way of example and it is not restrictive, therefore any other possible embodiment is to be considered as covered by the patent hereby applied for, as hereinbefore described and as claimed here below.

What is claimed is:

1. A unit at a taping station for taping containers with a strip of adhesive tape disposed along a line for conveying containers spaced from one another by a spacing, said taping unit comprising:

an operating head movable alternatively in a direction transverse to said conveying line between an outer position and an inner position respectively with respect to said spacing, said head being fastened to an end of at least one rod;

a support body integral with a frame to slidably guide said at least one rod;

a rear head carrying an articulated arm for driving said operating head between its outer and inner positions, said rear head being driven in reciprocating motion by motive means;

a pair of articulated rocker means on said operating head to intercept a strip of adhesive tape extending from a longitudinal wall of a container downstream of said taping station, said pair of rocker means being biased to diverge outwardly when inserted into said spacing to act by pressure on front and rear faces of containers disposed downstream and upstream respectively of said taping station;

a stem slidable within said rod and having at the end of said operating head a cutting means to cut said strip of adhesive tape held by said rocker means;

means for driving said stem in relation to the insertion of said operating head in said inner position into said spacing at the taping station, means for biasing said driving means to keep said cutting means retracted toward said operating head when said operating head is in said outer position;

wedge means fastened to a support body for insertion between said rocker means when said operating head is in the outer position to actuate a closing of said pair of rocker means.

2. A unit according to claim 1, wherein each said rocker means includes:

an upper rocker and a lower rocker mounted parallel to each other on said operating head;

a roller mounted on the front end of each said rocker for intercepting said strip of adhesive tape and to act by pressure on a face of a container;

a further roller mounted on the rear end of said rocker end for receiving said wedge between the rocker means when said operating head is in said outer position.

3. A unit according to claim 1, wherein said means for driving said stem comprises a swinging lever mounted on said rear head, said lever having a roller at one end to engage a longitudinal cam fixed on said frame and to act at an opposite end on said stem integral with said cutting means.

* * * * *